US010138602B2

(12) United States Patent
Olbrich et al.

(10) Patent No.: US 10,138,602 B2
(45) Date of Patent: Nov. 27, 2018

(54) FASTENING POINT, IN WHICH A RAIL FORMING PART OF A TRACK FOR RAIL VEHICLES IS MOUNTED ON A FOUNDATION

(71) Applicant: Vossloh-Werke GmbH, Werdohl (DE)

(72) Inventors: Tim Olbrich, Neuenrade (DE); Dietmar Becker, Iserlohn (DE); Martin Gnaczynski, Plettenberg (DE)

(73) Assignee: Vossloh-Werke GmbH, Werdohl (DE)

( * ) Notice: Subject to any disclaimer, the term of this patent is extended or adjusted under 35 U.S.C. 154(b) by 0 days.

(21) Appl. No.: 15/524,306

(22) PCT Filed: Nov. 4, 2015

(86) PCT No.: PCT/EP2015/075662
§ 371 (c)(1),
(2) Date: May 4, 2017

(87) PCT Pub. No.: WO2016/071379
PCT Pub. Date: May 12, 2016

(65) Prior Publication Data

US 2017/0321382 A1 Nov. 9, 2017

(30) Foreign Application Priority Data

Nov. 5, 2014 (DE) ..... 10 2014 116 142

(51) Int. Cl.
*E01B 9/40* (2006.01)
*E01B 9/48* (2006.01)
(Continued)

(52) U.S. Cl.
CPC ..... *E01B 9/483* (2013.01); *E01B 9/40* (2013.01); *E01B 9/42* (2013.01); *E01B 9/48* (2013.01); *E01B 9/68* (2013.01)

(58) Field of Classification Search
CPC ..... E01B 9/00; E01B 9/02; E01B 9/04; E01B 9/10; E01B 9/28; E01B 9/30; E01B 9/38; E01B 9/44; E01B 9/46; E01B 9/48
See application file for complete search history.

(56) References Cited

U.S. PATENT DOCUMENTS 7,992,796 B2 8/2011 Bednarczyk
2013/0015256 A1* 1/2013 Bednarczyk ..... E01B 9/02 238/315

FOREIGN PATENT DOCUMENTS

BE 1018608 A6 5/2011
CN 2227139Y Y 5/1996
(Continued)

*Primary Examiner* — Robert J McCarry, Jr.
(74) *Attorney, Agent, or Firm* — The Webb Law Firm

(57) ABSTRACT

A fastening point for a rail on a foundation including a bedplate arranged on a support surface of the foundation. The bedplate includes a bearing surface formed on its underside associated with the foundation and also a through-opening, a spring element for exerting an elastic holding-down force on a rail foot and a clamping screw, which braces the spring element against the bedplate. The clamping screw is guided with its threaded shaft through the through-opening of the bedplate. The clamping screw acts with its screw head against the spring element and is screwed into a thread provided in a region of the through-opening of the bedplate. A free space is provided in a region underneath the bedplate in the extension of the through-opening of the bedplate, into which the threaded shaft of the clamping screw can be inserted.

15 Claims, 2 Drawing Sheets

(51) Int. Cl.
*E01B 9/42* (2006.01)
*E01B 9/68* (2006.01)

(56) References Cited

FOREIGN PATENT DOCUMENTS

| | | | |
|---|---|---|---|
| CN | 102498246 | A | 6/2012 |
| CN | 203593920 | U | 5/2014 |
| DE | 68917889 | T2 | 1/1995 |
| DE | 4406105 | A1 | 8/1995 |
| DE | 19745326 | A1 | 4/1999 |
| DE | 102004031632 | A1 | 1/2006 |
| DE | 102009041848 | A1 | 3/2011 |
| EP | 0192268 | A2 | 8/1986 |
| LU | 81085 | | 4/1980 |

* cited by examiner

FASTENING POINT, IN WHICH A RAIL FORMING PART OF A TRACK FOR RAIL VEHICLES IS MOUNTED ON A FOUNDATION

CROSS-REFERENCE TO RELATED APPLICATIONS

This application is the United States national phase of International Application No. PCT/EP2015/075662 filed Nov. 4, 2015, and claims priority to German Patent Application No. 10 2014 116 142.4 filed Nov. 5, 2014, the disclosures of which are hereby incorporated in their entirety by reference.

BACKGROUND OF THE INVENTION

Field of the Invention

The invention relates to a fastening point, in to which a rail forming part of a track for rail vehicles is mounted on a foundation, wherein the fastening point includes

- a bedplate arranged on a support surface of the foundation, which bedplate comprises a support surface formed on the upper side of the bedplate associated with the rail, a bearing surface formed on the underside of the bedplate associated with the foundation, and also a through-opening leading from the underside to the upper side of the bedplate,
- a spring element, which exerts an elastic holding-down force on the rail foot, and
- a clamping screw, which braces the spring element against the bedplate, wherein the clamping screw is guided with its threaded shaft through the though-opening of the bedplate.

Description of Related Art

Such a fastening point is known for example from DE 10 2009 041 848 A1. The special feature in the known fastening point consists in particular in that its bedplate is made of a plastic material, wherein the bedplate is designed having regard to its function, a minimum weight and an optimised rigidity. In this connection it is particularly important that the bedplate fabricated from plastic stands on an elastic intermediate layer arranged between the bedplate and the solid foundation. This enables the elasticity of a comparatively large-volume intermediate layer to be utilised for an extremely accurate pre-determinable flexibility of the fastening effected with the system according to the invention when driven over by a rail vehicle.

As is usual with fastening points of the type discussed here, in the known fastening point two conventional spring elements are provided, formed respectively as co-shaped tension clamps, one of which is respectively arranged on one of the longitudinal sides of the rail to be fastened. When the fastening point is installed ready the spring elements press with their spring arms on the side of the rail foot respectively associated with them and thus exert an elastic holding-down force, through which the rail is pressed against the bedplate.

In order to brace the spring elements, in the known fastening point a clamping screw is inserted from the underside of the bedplate through its associated through-opening and thereby engages through a central hoop of the respective spring element sitting on the bedplate. By screwing a nut onto the threaded section the central hoop of the spring element is moved relative to its spring arms supported on the rail foot in the direction of the bedplate. The spring element is in this way elastically tensioned so that the rail is held with a defined elastic holding-down force on the bedplate.

In order to prevent the elastic layer disposed underneath the bedplate from being damaged by the screw head of the clamping screw a recess is formed in the bedplate from the underside of the bedplate, in which the screw head is held in a rotation-proof manner in relation to the longitudinal axis of the clamping screw. The depth of the recess should in this connection be dimensioned so that the screw head with its free front surface does not project beyond the underside of the bedplate, and optimally is aligned flush with the latter.

The fixing of the bedplate on the foundation is performed with the known fastening point via fastening screws, which are guided by additional through-openings formed in the bedplate and are screwed into dowels, which are recessed in the foundation cast as a rule from concrete or a similar material. The fastening of the bedplate is in this connection accomplished so that it is height-moveable in a height direction aligned normal to the support surface of the foundation corresponding to the elastic flexibility of the intermediate plate carrying it, but is fixed in the longitudinal direction of the rail and in a transverse direction aligned transverse to the rail and parallel to the support surface of the foundation. With the aid of suitable stop elements the maximum travel of the bedplate in the height direction is restricted. In this connection an eccentric device can be provided in the known fastening point, by means of which the exact alignment of the bedplate is simplified during installation.

The known fastening points have proved effective in practice and enable not only an optimally elastic support of the rail, but also a simple installation with favourable production costs. In particular the known fastening points can be pre-mounted in a simple manner and brought in the pre-mounted state to the installation site, where a rapid final installation can take place. In this way the holding-down force applied in each case by the spring element can be adjusted exactly in each case by a more or less strong tightening of the nut screwed on to the threaded shaft of the clamping screw projecting freely upwardly from the bedplate.

After the final installation the clamping screws used for tensioning the spring elements can no longer be installed separately. Instead, the whole fastening point must be dismantled for their replacement.

SUMMARY OF THE INVENTION

Against this background of the prior art an object of the invention is accordingly to redesign the known fastening point so that with it a replacement of the clamping screws is possible without thereby losing the possibility envisaged in the known system of an exact adjustment of the holding-down force exerted by the respective spring element.

To achieve this object the invention has proposed a fastening point with the features described herein.

A fastening point according to the invention, in which a rail as part of a track for rail vehicles is fastened to a foundation, accordingly includes in agreement with the prior art discussed in the introduction a bedplate arranged on a support surface of the foundation, which bedplate comprises a support surface formed on the upper side of the bedplate associated with the rail, a bearing surface formed on the underside of the bedplate associated with the foundation, and also a through-opening leading from the underside to the upper side of the bedplate, a spring element that exerts an elastic holding-down force on the rail foot, and a clamping screw, which braces the spring element against the bedplate, wherein the clamping screw is guided with its threaded shaft through the through-opening of the bedplate.

According to the invention the clamping screw now acts with its screw head against the spring element, the clamping screw being screwed with the threaded section of its threaded shaft into a thread provided in the region of the through-opening of the bedplate. In this connection a free space is provided in a region present underneath the bedplate in the direction of the foundation in an extension of the through-opening of the bedplate, into which the threaded shaft of the clamping screw can be inserted via its free end.

In a fastening point according to the invention the clamping screw is thus guided in the opposite direction through the through-opening compared to the arrangement in the prior art known from DE 10 2009 041 848 A1 and is screwed in with a thread that is provided on the bedplate. In this way the spring element is forced by the screw head against the bedplate so that the spring element can be tensioned by the necessary amount in order to generate the required elastic holding-down force.

In order on the one hand to enable a reliable screwing of the clamping screw into the associated thread and on the other hand to maintain a sufficient degree of freedom of travel for the adjustment of the holding-down force exerted by the spring element, the region of a fastening point according to the invention provided underneath the bedplate is configured so that the clamping screw in the case of an adjustment required to intensify the holding-down force is freely moveable in the direction of the foundation, i.e. does not encounter any resistance that hinders its free adjustment.

The free space provided for this purpose according to the invention underneath the bedplate in the direction of the foundation can in principle be formed by a recess aligned in alignment with the through-opening associated with the clamping screw, which recess is formed in an intermediate plate elastic in the gravitational force direction that is optionally provided underneath the bedplate, and into which the free end of the threaded shaft of the clamping screw can be inserted. A precondition for this is that the intermediate plate even in the fully compressed state is still sufficiently thick so that the tip of the clamping screw projecting into the recess forming the free space strikes neither material of the intermediate plate nor the foundation when utilising the maximum spring travel.

A maximum freedom in the adjustment of the clamping screw in the direction of the foundation is then obtained if, in a fastening point according to the invention, a recess is formed in the support surface of the foundation, which is arranged in alignment with the through-opening of the bedplate and forms the free space into which the free end of the threaded shaft of the clamping screw can be introduced. The size and depth of the recess can be freely chosen, since it has no direct influence on the properties and the behaviour of functional elements of the fastening point.

If an elastic intermediate plate is provided, the recess then provided in it to accommodate the free end of the threaded shaft of the clamping screw can be formed as a through-opening leading from the underside of the intermediate plate associated with the foundation to its upper side associated with the bedplate, with which in turn the recess formed in the foundation is arranged flush.

In order on the one hand to ensure a uniform support on the foundation of the plates provided in each case in a fastening point according to the invention and at the same time to minimise the abrasive wear, in particular in the case where an elastic intermediate layer is present, it may be expedient if a support plate sits on the support surface of the foundation, on which support plate are supported the bedplate and the optional further plates of a fastening point according to the invention.

In the case where the free space provided according to the invention for the end section of the threaded shaft of the clamping screw guided through the bedplate is formed in a recess shaped in the foundation, the support plate expediently sits with a projection formed on its underneath associated with the foundation in the recess shaped in the foundation, wherein in the support plate a recess is formed starting from its upper side associated with the bedplate in the region of the projection, which recess is arranged in alignment with the through-opening of the bedplate and into which the free end of the threaded shaft of the clamping screw can be inserted. By means of this arrangement the support plate shields the components of the fastening point according to the invention, despite the fact that the free space for the free end section of the threaded shaft extending in use as far as the foundation is formed in the foundation, fully against the foundation. The danger that moisture from the foundation will reach the components of the fastening point through openings formed in the support plate, is thus minimised. The complete isolation achieved by the support plate configured according to the invention thus contributes to an optimum electrical insulation of the fastening point with respect to the foundation. For this purpose also the support plate itself can consist of a non-electrically conducting material.

If the bedplate installed in a fastening point according to the invention is fabricated from plastic, then, as in the prior art, there are obtained the advantages of an optimally free configurational possibility, a low weight and a good electrical insulation.

In principle it is conceivable to shape the thread provided for the coupling of the clamping screw to the bedplate directly in the bedplate of a fastening point according to the invention. If the material properties of the material used for the production of the bedplate are not sufficient to ensure a permanently reliable retention, then the thread provided in the region of the through-opening associated with the clamping screw can be provided by a nut, which is arranged on the underside of the bedplate. In order here too to make an optimally simple adjustability of the clamping screw possible, a nut receptacle can be shaped in the underneath of the bedplate in the region of its through-opening associated with the clamping screw, in which the nut is held in a rotation-proof manner with respect to the longitudinal axis of the clamping screw. The relevant receptacle can be shaped according to the model of the receptacle that is disclosed in the prior art known from DE 10 2009 041 848 A1 for the screw head of the clamping screw provided there.

The fastening of the bedplate to the foundation can also be accomplished according to the model from DE 10 2009 041 848 A1 that has proved to be of practical use. Accordingly the bedplate can have at least one further through-opening leading from its underside to its upper side, through which a fastening element fixed to the foundation is guided, by means of which the bedplate is fixed by positive engagement in the longitudinal direction of the rail and in a transverse direction crosswise to the longitudinal direction of the rail and parallel to the support surface of the foundation, but is displaceable in a height direction aligned normal to the support surface of the foundation.

In order to prevent the bedplate and the rail lifting off from the foundation, then also in the system according to the invention as in the fastening point known from DE 10 2009 041 848 A1, a stop element can be provided, forming a stop that restricts the maximum travel of the bedplate in the height direction.

As fastening element for the fixing of the bedplate to the foundation conventional sleeper screws may be used, which for the fixing are screwed into a dowel recessed in the foundation.

Normally the support surface of the bedplate is bounded laterally by in each case a shoulder that absorbs the transverse forces occurring when a rail vehicle passes over the fastening point, and thus forms a lateral guidance of the rail.

If the rail is to be aligned in a fastening point according to the invention at a certain angle in relation to the foundation, then for this purpose a wedge plate can be arranged between the foot of the rail and the support surface of the bedplate, which has a bearing surface associated with the support surface and a support surface associated with the rail, on which the rail foot is supported, wherein the support surface and the bearing surface in the cross-section transverse to the longitudinal direction of the rail enclose an acute angle.

An additional adjustability of the fastening point in the height direction can in this connection be achieved if the wedge plate is fixed in a positive engagement manner with respect to the transverse direction between two shoulders formed on the upper side of the bedplate, but is displaceable in the height direction.

One or more height adjustment plates can be arranged between the wedge element and the bedplate, in order to ensure an optimal support of the rail also in the case of structurally caused height deviations of the foundation.

A particularly versatile use of the invention is achieved if the wedge plate is replaceably held on the bedplate. To this end a housing can for example be formed on the bedplate, in which the wedge plate can be inserted under positive engagement, so that it is fixed in the longitudinal direction and in the transverse direction. Different angles of inclination of the rail can be adjusted by replacing the wedge plate. Also, it is of course possible to provide a flat plate instead of the wedge plate, in order to adjust a vertical alignment of the rail substantially with reference to the support surface of the foundation. In exactly the same way the rail can also be laid directly on the bedplate, if neither a height compensation is to be performed nor a specific inclination of the rail is to be adjusted.

The exchangeability of the wedge plate also enables the width of the support surface available on the bedplate to be adapted to the effective width of the respective rail profile. Also adaptor strips can be provided for this purpose, which bridge free spaces present between the shoulders bordering the support surface of the wedge element or of the bedplate, and the respective rail foot.

BRIEF DESCRIPTION OF THE DRAWINGS

The invention is described in more detail hereinafter with the aid of a drawing illustrating an exemplary embodiment, in which the figures show respectively schematically.

DESCRIPTION OF THE INVENTION

Figure 1:
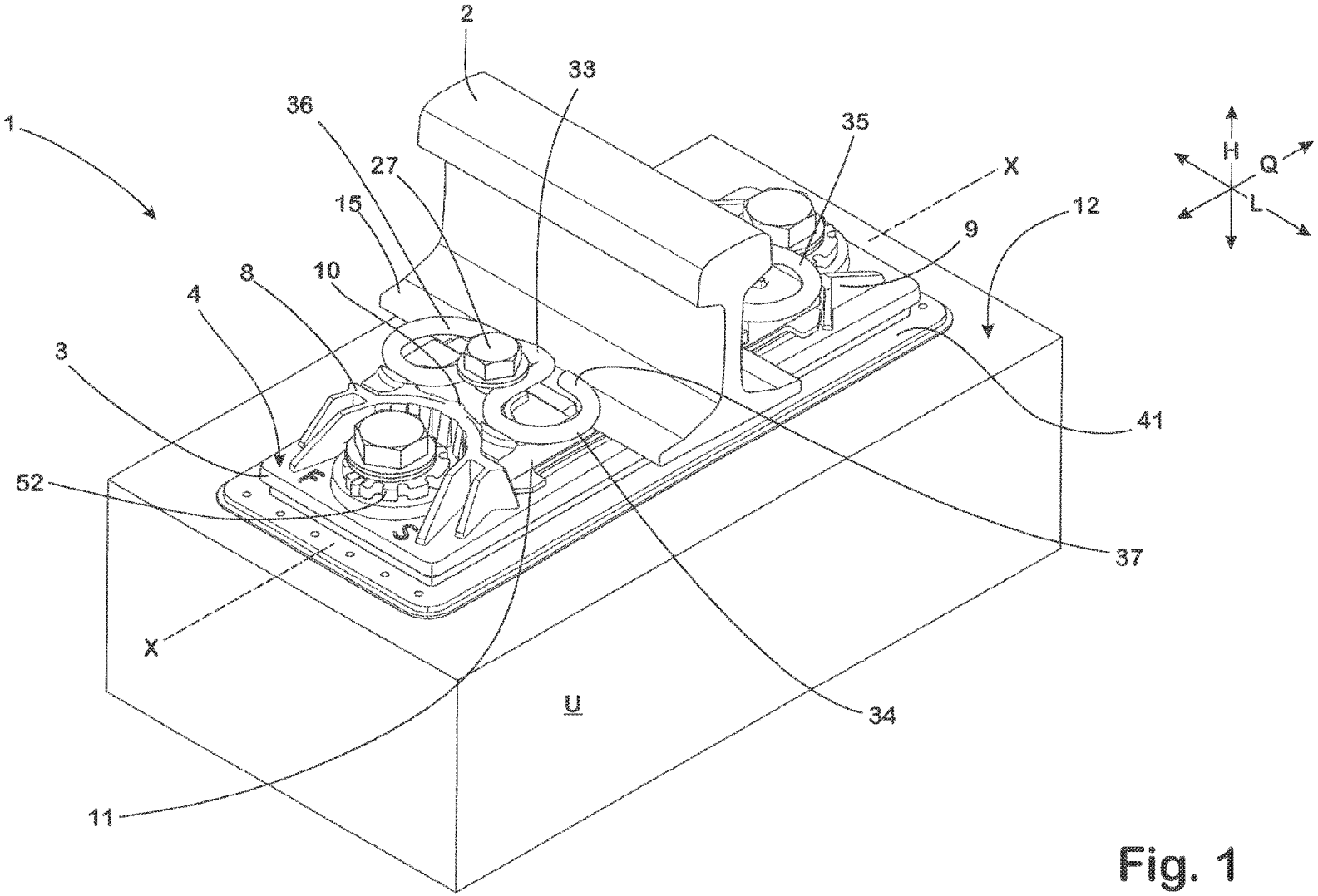
FIG. 1 a fastening point for a rail in a perspective view from above.

The fastening point 1 for fastening a rail 2 to a fixed foundation U formed for example by a cast concrete sleeper or plate comprises a bedplate 3, which is fabricated from a fibre-reinforced plastic for example that is normally used for this purpose.

The bedplate 3 formed as one piece has at its free upper side 4 a centrally arranged flat support surface 5 and on its underside 6 associated with the foundation, a likewise flat bearing surface 7.

At the side the support surface 5 is in each case bounded by a shoulder 8, 9, which seen in plan view has a curved shape in the direction of the rail 2. A projection 10 is formed on the vertices of the shoulders 8, 9, extending in each case over the height of the shoulders 8, 9.

A wedge plate 11 is arranged between the thereby formed shoulders 8, 9 in such a way that it is height adjustable in a height direction H aligned normal to the flat support surface 12 formed on the free upper side of the foundation U, but is fixed in a positive engagement manner in the longitudinal direction L of the rail 2 and in the transverse direction Q aligned transverse thereto and parallel to the support surface 12.

The wedge plate 11 sits with its bearing surface 13 on a height compensation plate 14, which is laid on the support surface 5 of the bedplate 3.

The rail 2 stands on the other hand with its rail foot 15 on the flat support surface 16 of the wedge plate 11 associated with the rail foot. The support surface 16 encloses with the bearing surface 13 of the wedge plate 11 an acute angle of a few degrees, so that the rail 2 is aligned at a correspondingly large defined angle of inclination with respect to the support surface 12 of the foundation U.

The shoulders 8, 9 form a recess, into which the wedge plate 11 can be releasably inserted coming from the height direction H. This enables by simple replacement wedge plates 11 that differ by the angles of inclination between their bearing surface 13 and their support 16 or by the width of their support surface, to be mounted on the bedplate 3.

The position of the rail 2 on the support surface 16 of the wedge plate 11 is in this connection fixed by adaptor pieces 17, 18, which are arranged between the respective longitudinal edge of the rail foot 15 and a shoulder 19, 20 of the wedge plate 11 laterally delimiting the respective wedge plate 11.

Two through-openings 21, 22 are formed in the support surface 5 of the bedplate 3 in each case laterally of the rail foot 15, the openings leading from the upper side 4 to the underside 6 of the bedplate 3. The through-openings 21, 22 terminate at the underside 6 of the bedplate 3 in nut receptacles 23, 24 additionally formed there. Correspondingly arranged through-openings are formed in the shoulders 19, 20 of the wedge plate 11.

Nuts 25, 26 sit in the nut receptacles 23, 24. Conventionally formed clamping screws 27, 28 are screwed into the nuts 25, 26 via the threaded section of their respective threaded shaft 29, 30. The clamping screws 27, 28 are in this connection guided from the upper side 4 of the bedplate 3 through the respective through-opening of the wedge plate 11 and the respective through-opening 21, 22 of the bedplate 3.

The nut receptacles 23, 24 are formed in a manner known per se, so that the nuts 25, 26 are held in a rotation-proof manner in relation to the longitudinal axis about which the clamping screws 27, 28 are turned when they are screwed into the nuts 25, 26. At the same time the depth of the nut receptacles 23, 24 is dimensioned so that the nuts 25, 26 with their side associated with the foundation U are aligned flush with the underside 6 of the bedplate 3.

The clamping screws 27, 28 act with their screw head 31, 32 on the middle hoop 33 respectively of a conventionally designed, co-formed tension clamp 34, 35, which are supported with the free ends of their holding arms 36, 37 on the side respectively associated with them of the rail foot 15, and there exert an elastic holding-down force.

An elastic intermediate plate 38 is arranged between the foundation U and the bedplate 3, which extends over the width and length of the bedplate 3. In the region of the through-openings 21, 22 of the bedplate 3 recesses 39, 40 formed as through-openings are made in the intermediate plate 38, the dimensions of the recesses being so that the threaded shaft 29, 30 of the respective clamping screw 27, 28 can be inserted with a degree of play through the recesses 39, 40.

The intermediate plate 38 sits on a support plate 41, whose width and length are dimensioned so that it extends with an edge region beyond the width and length of the intermediate plate 38.

Pot-shaped projections 42, 43 are formed on the support plate 41, which project in the direction of the foundation U and surround recesses 44, 45 in the direction of the bedplate 3. The recesses 44, 45 are aligned in alignment with the through-openings 21, 22 and with the recesses 39, 40, and are dimensioned so that the free ends of the threaded shafts 29, 30 of the clamping screws 27, 28 can also be introduced loosely into them with a degree of play.

The projections 42, 43 are fitted into the foundation U and are surrounded by the material of the foundation U and also form recesses there, in which the projections 42, 43 sit in a positive engagement manner. The recesses 44, 45 form in this way free spaces for the movement of the clamping screws 27, 28 that takes place in the direction of the foundation U when the clamping screws are screwed into the nuts 25, 26.

The positional fixing of the bedplate 3, moveable in the height direction H but immovable in the longitudinal direction L and transverse direction Q, takes place in a manner known per se from DE 10 2009 041 848 A1 by means of fastening screws 46, 47, which are guided through through-openings formed in the side end sections of the bedplate 3, the intermediate plate 38 and the support plate 41, and are screwed into plastic dowels 48, 49 which are embedded in the foundation U.

The fastening screws 46, 47 are guided in stop elements 50, 51 formed in the manner of a sleeve, which are inserted through the respective through-openings of the bedplate 3 and of the intermediate plate 11 and stand on the support plate 41. The stop elements 50, 51 have at their upper edge, on which the head of the respective fastening screw 46, 47 is supported, a radially projecting, surrounding collar 52, which forms a stop means for the movement of the bedplate 3 in the height direction H. By means of the stop elements 50, 51, an eccentric adjustment can be accomplished as already described in DE 10 2009 041 848 A1, so to adjust the position of the bedplate 3 in the longitudinal direction L and transverse direction Q.

Figure 2:
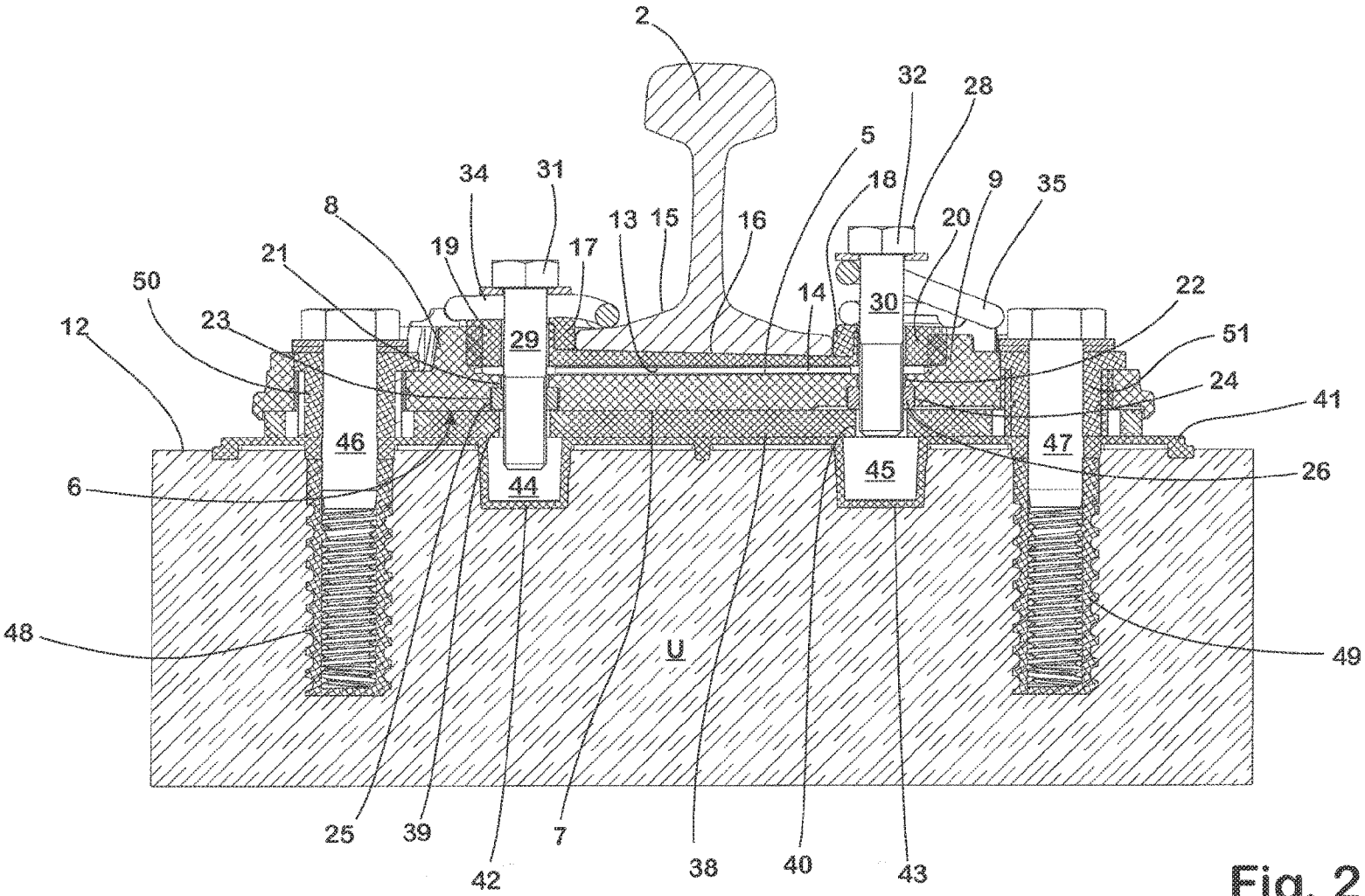
FIG. 2 the fastening point in a section along the sectional line X-X illustrated in FIG. 1 transverse to the longitudinal extension of the rail.

In the pre-installed state illustrated in FIG. 2 on the side to the right of the rail 2, the clamping screw 28 is screwed with the threaded section of its threaded shaft 47 into the nut 26 until the free end of the threaded shaft 47 reaches the recess 40 of the intermediate plate 38. The tension clamp 35 is in this state only slightly braced, its middle hoop still standing inclined upwardly.

For the finished installation the tension clamp 35 is displaced in the direction of the rail 2, until the free end of its holding arms sits on the associated side of the rail foot 15. The clamping screw 30 is then tightened, so that its middle hoop is swiveled in the direction of the foundation U, until it reaches its end position and the required holding-down force is exerted by the tension clamp 35 on the rail foot 15. In the course of the tightening the clamping screw 30 penetrates further with its free threaded shaft ends into the associated recess 45, before the end position is reached, which is shown in FIG. 2 on the side to the left of the rail 2 for the tension clamp 34 and the clamping screws 27.

LIST OF REFERENCE NUMERALS

1 Fastening point for the fastening
2 Rail
3 Bedplate
4 Free upper side of the bedplate 3
5 Flat support surface of the bedplate 3
6 Underside of the bedplate 3
7 Bearing surface of the bedplate 3
8,9 Shoulders of the bedplate 3
10 Projection
11 Wedge plate
12 Support surface of the foundation U
13 Bearing surface of the wedge plate 11
14 Height compensation plate
15 Rail foot
16 Support surface of the wedge plate 11
17,18 Adaptor strips
19,20 Shoulders of the wedge plate 11
21,22 Through-openings of the bedplate 3
23,24 Nut receptacles
25,26 Nuts (with provided threads)
27,28 Clamping screws
29,30 Threaded shaft of the clamping screws 27, 28
31,32 Screw head of the clamping screws 27, 28
33 Respective middle hoops of the tension clamps 34,35
34,35 Tension clamps (spring element)
36,37 Holding arms of the tension clamps 34, 35
38 Intermediate plate
39,40 Recesses of the intermediate plate 38
41 Support plate
42,43 Projections of the support plate 41
44,45 Recesses of the support plate 41 (free spaces)
46,47 Fastening screws
48,49 Plastic dowels
50,51 Stop elements
52 Surrounding collar of the stop element 50, 51
H Height direction
L Longitudinal direction of the rail 2
Q Transverse direction
U Foundation

The invention claimed is:

1. A fastening point, in which a rail forming part of a track for rail vehicles is fixed to a foundation, the fastening point comprising:

a bedplate arranged on a support surface of the foundation, the bedplate comprising a support surface formed on an upper side of the bedplate associated with the rail, a bearing surface formed on an underside of the bedplate associated with the foundation, as well as a through-opening leading from the underside to the upper side of the bedplate, a spring element, which exerts an elastic holding-down force on the rail foot, and a clamping screw, which braces the spring element against the bedplate, wherein the clamping screw is guided with its threaded shaft through the through-opening of the bedplate, and wherein the clamping screw acts with its screw head against the spring element, the clamping screw is screwed with a thread section of its threaded shaft into a thread provided in a region of the through-opening of the bedplate, and a free space is provided in a region present in a direction of the foundation underneath the bedplate, in an extension of the through-opening of the bedplate, into which free space the threaded shaft of the clamping screw is adapted to be inserted via its free end.

2. The fastening point according to claim 1, wherein an intermediate plate elastic in a gravitational force direction is arranged between the bedplate and the foundation, in which is formed a recess arranged in alignment with the through-opening of the bedplate, which recess forms the free space into which the free end of the threaded shaft of the clamping screw is adapted to be inserted.

3. The fastening point according to claim 2, wherein the recess is formed as a through-opening leading from the underside of the intermediate plate associated with the foundation to its upper side associated with the bedplate.

4. The fastening point according to claim 1, wherein a recess is formed in the support surface of the foundation, which is arranged in alignment with the through-opening of the bedplate and forms the free space into which the free end of the threaded shaft of the clamping screw is adapted to be introduced.

5. The fastening point according to claim 1, wherein a support plate sits on the support surface of the foundation, on which support plate the bedplate is supported.

6. The fastening point according to claim 5, wherein the support plate with a projection formed on its underside associated with the foundation sits in the recess formed in the foundation, and wherein in the support plate a recess is formed starting from its upper side associated with the bedplate in a region of the projection, which recess is arranged in alignment with the through-opening of the bedplate and into which the free end of the threaded shaft of the clamping screw is adapted to be introduced.

7. The fastening point according to claim 1, wherein the thread provided in the region of the through-opening of the bedplate associated with the clamping screw is provided by a nut, which is arranged on the underside of the bedplate.

8. The fastening point according to claim 7, wherein a nut receptacle is formed in the underside of the bedplate in the region of its through-opening associated with the clamping screw, in which the nut is held in a rotation-proof manner with respect to a longitudinal axis of the clamping screw.

9. The fastening point according to claim 1, wherein the bedplate comprises at least one further through-opening leading from its underside to its upper side, through which is guided a fastening element fixed to the foundation, such that the bedplate is fixed in a positive engagement manner in a longitudinal direction of the rail and in a transverse direction aligned transverse to the longitudinal direction of the rail and parallel to the support surface of the foundation, and fixed displaceably in a height direction aligned normal to the support surface of the foundation.

10. The fastening point according to claim 9, wherein a stop element is provided, which forms a stop that limits the maximum travel of the bedplate in the height direction.

11. The fastening point according to claim 9, wherein the fastening element is a screw, which for the fixing is screwed into a dowel recessed in the foundation.

12. The fastening point according to claim 1, wherein the bedplate comprises a plastic material.

13. The fastening point according to claim 1, wherein a wedge plate is arranged between the rail foot and the support surface of the bedplate, the wedge plate comprising a bearing surface associated with the support surface and a support surface associated with the rail, on which the rail foot is supported, and that the support surface and the bearing surface enclose an acute angle in a cross-section transverse to a longitudinal extension of the rail.

14. The fastening point according to claim 13, wherein the wedge plate is fixed by positive engagement between two shoulders formed on the upper side of the bedplate, referred to the transverse direction and the longitudinal direction, but is displaceable in the height direction.

15. The fastening point according to claim 14, wherein the wedge plate is replaceable.

* * * * *